United States Patent [19]

Broske

[11] Patent Number: 4,949,491

[45] Date of Patent: Aug. 21, 1990

[54] DIFFERENTIAL RECOIL DIFFUSER

[76] Inventor: William F. Broske, P.O. Box 621, Orienal, N.C. 28571

[21] Appl. No.: 342,851

[22] Filed: Apr. 25, 1989

[51] Int. Cl.[5] ..... F41C 27/22

[52] U.S. Cl. ..... 42/1.06; 188/378

[58] Field of Search ..... 42/1.06; 89/14.3, 44.01, 89/44.02; 188/378, 268; 267/136

[56] References Cited

U.S. PATENT DOCUMENTS

| | | | |
|---|---|---|---|
| 3,290,815 | 12/1966 | Edwards | 42/1.06 |
| 3,300,889 | 1/1967 | Baker | 42/1.06 |
| 3,335,515 | 8/1967 | Bennett | 42/1.06 |
| 3,376,031 | 4/1968 | Lee | 267/136 |
| 3,381,405 | 5/1968 | Edwards | 42/1.06 |
| 3,408,062 | 10/1968 | Baker | 42/1.06 |
| 3,650,060 | 3/1972 | Schubert | 42/1.06 |
| 3,683,534 | 8/1972 | Davis | 42/1.06 |
| 3,767,222 | 10/1973 | Willetts | 267/136 |
| 4,279,091 | 7/1981 | Edwards | 42/1.06 |
| 4,492,050 | 1/1985 | Kagehiro | 42/1.06 |

*Primary Examiner*—Charles T. Jordan
*Assistant Examiner*—Michael J. Carone
*Attorney, Agent, or Firm*—Jay M. Cantor

[57] ABSTRACT

A recoil diffuser (10) includes a plurality of weight elements (20, 22) and a plurality of plastic spring elements (30, 32, 40) fitted within a tube (12) to operate differentially upon being subjected to the forces of recoil as in a shotgun or the like. The end surfaces of the weight elements and of the plastic spring elements (see 24, 28) are shaped to optimize spring forces relative to displacement relative to overall size of the unit and mass of the weights.

10 Claims, 1 Drawing Sheet

DIFFERENTIAL RECOIL DIFFUSER

FIELD OF THE INVENTION

The present invention relates to a recoil diffuser of the type used in weapons such as shotguns to diffuse the impact caused by firing of such weapons.

BACKGROUND OF THE INVENTION

Recoil diffusers have been widely used with respect to weapons of all types including personal weapons such as shotguns or, with respect to guns, rifles, and howitzers; all intended to ease the impact or shock caused when the weapon is fired. With respect to personnel weapons, the purpose is to reduce injury to the individual shooter, both to the shoulder and to the face which is frequently impacted due to the need for aiming. With respect to larger ordinances, recoil impact cannot only displace the weapon relative to its aiming lines, but can cause in time damage to the mechanisms of the weapon. To ease these problems, a variety of solutions have been attempted, including the simple addition of mass which itself alters the recoil characteristic. With respect to larger weapons, pneumatic, hydraulic, spring-loaded masses, and various combinations thereof have all been employed. With respect to personnel weapons where weight and balance are critical, particularly with respect to skeet and trap shooting, added weight and weight placement becomes a design problem. Even so, a host of commercial recoil diffusers have evolved. Some use metallic liquid such as mercury which may be caused to flow through a constriction driven by a recoil impact such as taught in U.S. Pat. No. 3,335,515. Others use weight in the form of a movable slug against the body of a spring such as in U.S. Pat. Nos. 3,381,405; 3,300,889; and 3,290,815. Liquid metal is both expensive and toxic as well as being difficult to contain over time. Mechanical springs are useful but require lubrication to avoid sticking or hanging up, particularly with respect to long periods of non-use and under field conditions, heat, cold, moisture, and the like.

With the foregoing background, it is to be understood that the present invention has as an object an improved recoil diffuser for use with weapons, particularly personnel weapons. It is a further object of the invention to provide a recoil diffuser which operates differentially in reacting to the high velocity impact forces associated with explosives and propellants as used in present day ammunition. It is still a further object of the invention to provide a low-cost and highly reliable recoil diffuser of a design optimizing shape versus performance and weight through novel geometries of the constituent parts.

SUMMARY OF THE INVENTION

The present invention features a tube made to contain a plurality of weights therein dimensioned to move freely within the tube and held spaced apart by plastic spring elements, the assembly being relatively confined by plugs placed in the ends of the tubes and clinched therein. In accordance with a preferred embodiment of the invention, the weights are made to have different masses in order to move differentially upon experiencing recoil-generated impact. Further in accordance with the invention, the ends of the weights are curved inwardly in a concave sense with the ends of the plastic springs similarly curved but in a convex shape to a greater extent to allow for an air space between the surfaces of springs and weights. The plastic spring elements are given a durometer selected relative to the particular geometries of the springs to provide a particular force displacement characteristic resulting in an overall or combined impact displacement curve diffusing the force of impact over time and reducing the maximum force to acceptable levels.

IN THE DRAWINGS

DETAILED DESCRIPTION OF THE INVENTION

Figure 1:
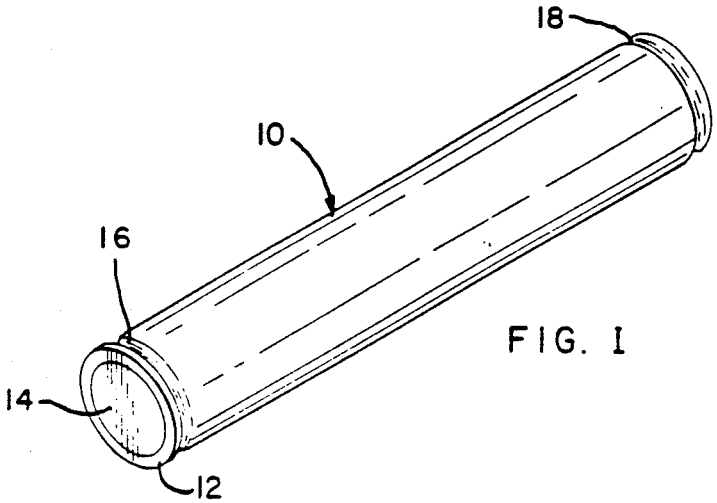
FIG. 1 is a perspective showing the recoil diffuser of the invention.

Referring now to FIG. 1, the recoil diffuser of the invention is shown as element 10 of a cylindrical or tubular configuration. Such configuration is essentially in the preferred embodiment adapted to fit within the cylindrical cavity found within the stocks of most shotguns and many rifles. The diffuser of the invention could be of cross-sectional geometries other than cylindrical. The diffuser of the invention includes a tubular element 12 clenched as at 16 and at 18 at the ends thereof to retain a plug element such as 14 shown in FIG. 1 at the outboard end of tube 12. In a preferred embodiment, the tube 12 is made of metallic tubing, such as aluminum, as are the endplugs such as 14. It is contemplated that the tube 12 may be of plastic material as may be the endplugs and combinations of plastic and metallic materials are also contemplated.

Figure 2:
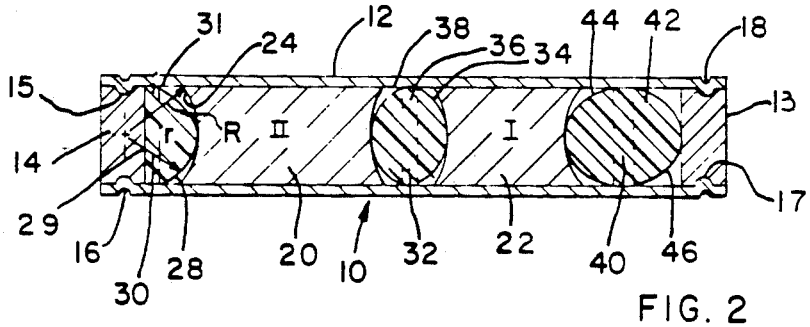
FIG. 2 is a side elevational and sectional view showing the constituent parts of the invention in a relaxed condition.

As can be seen in FIG. 2, the plugs 14 and 13 are grooved as at 15 and 17 to allow the clenching operation resulting in the deformation shown as 16 and 18 to effect a locking of the plugs and a sealing of the device without undue deformation of the plug elements. If the tube and plug elements are cleaned of their oxides just prior to clenching, an intermetallic bond between the surfaces of the aluminum parts will result around the periphery interiorly of the clenched zones.

As can be discerned from FIG. 2, tube 12 is made to further contain weights shown as elements 22 and 20 and further denominated for purposes to be hereinafter described as I and II, respectively. As can be seen, weight 22 is somewhat smaller and therefore lighter than weight 20. In a preferred embodiment, these weights are made of lead suitably cast to a dimension allowing complete freedom of movement for sliding engagement within tube 12. It has been found that the interface between lead and aluminum is self-lubricating without a tendency to bond or freeze during long periods of non-use. In the event that other materials, such as zinc, iron, steel, copper or bronze are employed, the device may be lubricated with a suitable lubricant compatible to the source of materials used; including of course the choice of material for the tubular element 12.

As can be observed from FIG. 2, the ends of each of the weight elements 20 and 22 have a concave shape as at the left-handed end of weight 20 denominated by numeral 24. This concave shape may be a rounded radius or hyperbolic to generally provide a radius R as indicated to the left-handed end of weight 20 taken from an arbitrary centerline.

In addition to the two weights 20 and 22, there are, as shown in FIG. 2, three spring elements 30, 32, and 40 which, in a preferred embodiment, are comprised of a plastic material such as urethane having a durometer on the order of between 30 and 40 units. The spring element 30 includes at one end a convex shape shown as 28 which has a geometry to fit within the concave surface 24 of weight 20 and, in its relaxed condition, provide a point contact with the center of weight 20 with an increasing space progressively outward from such center effected by providing a radius r essentially less than R. The term "radius" is not meant to limit the configuration of the convex and concave shapes to strictly circular configurations as other shapes, cone shapes, hyperbolic shapes, and variations thereof are fully contemplated. The important point is that there is a space between the surfaces of the spring elements and the weights allowing for deformation of the spring elements in addition to purely compressive deformation; in other words, to allow geometric shape changes which have the equivalence of a spring action.

With respect to the spring element 30, while one end is convex, end 28, the other end shown as 29 is flat to rest against the interior surface of plug 14. As can also be discerned, spring element 30 includes a flat exterior portion 31 which orients the spring element within tube 12.

Similar flats shown as 36 relative to spring element 32 and 42 relative to spring element 40 are provided and also maintain alignment of the spring elements within tube 12. As can be seen, spring element 32 includes convex surfaces 34 and 38 at opposite ends and spring element 40 includes convex surfaces 44 and 46 at opposite ends thereof. It is to be understood that, depending upon the particular characteristics of impact due to recoil, the convex surfaces of the spring elements may be altered to provide appropriate spring characteristics through geometrical deformation. Variations with respect to the hardness or springiness of the materials from which the spring elements are made, a host of durometers being available from a host of plastic materials and/or rubbers is also contemplated.

In use, the recoil diffuser 10 may be preferably employed in the stock bore which is utilized to lock a wooden or plastic stock to the metal portions of a gun, typically through a long bolt inserted through the stock bore to engage a threaded portion of the metal gun body. It is also contemplated that one or more of the recoil diffusers may be affixed to the exterior of a weapon through an appropriate carrier fastened by appropriate means to the barrel or other metal portions of the weapon.

In use, with the diffuser firmly affixed within or at least at some point to a weapon, recoil impact force applied to the right end of the diffuser 10 in conjunction with displacement leftward relative to FIG. 2 results in the following action. The lighter of the weights, element 20 and shown as I, begins to move first, compressing spring element 40. Shortly thereafter, element 22, II, begins its movement to the right, compressing element 32 which in turn drives element 20 for further compression of element 40. At some point, the elements 32 and 40 are as compressed as they will be for a given characteristic impact displacement and the weights 20 and 22 are displaced to the right as far as they will be for such characteristics whereupon the system will reverse itself with the spring elements 32 and 40 driving the weights back to their original positions within tube 12. At such time, the spring element 30 will operate, interfacing with the interior concave surface shown as 24 as will the other end surfaces of the weights operating on spring element 32.

Figure 3:
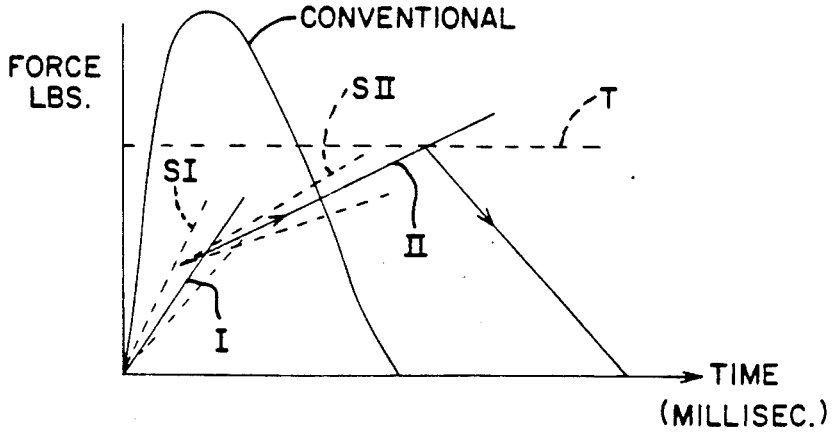
FIG. 3 is a force/time graphic representation of a recoil impact characteristic curve for a given weapon and superimposed thereon the kind of characteristic curve achieved by the differential recoil diffusing action of the invention.

FIG. 3 purports to show schematically this impact-/force/displacement transaction. In FIG. 3, the ordinate represents force and the abscissa of time. The curve shown thereon and marked as "conventional" represents a characteristic generated by a weapon such as a shotgun upon being fired, assuming a given load, and a given gun weight and a conventional butt plate. The line dotted in and shown as T represents a threshold line which, for the point of description, may be taken to represent a force limit above which results in either pain or tissue damage; or, in the case of use on other ordinances, forces which are destructive and wearing to other parts of the gun's system. Depicted in FIG. 3 and marked I is a force/time characteristic curve for the lighter weight I and also shown there is a force characteristic of the heavier weight II. It is contemplated that I begins its movement first being the lighter of the weights with II beginning its movement shortly thereafter. Shown dotted in and marked SI and SII are weight-/force/time characteristics resulting from the selective use of spring materials and/or geometries. Thus, if the spring materials and/or geometries resulted in a stiffer spring, the characteristic curve of I would be displaced upward. Conversely, with softer springs and/or more rounded spring sections, the characteristic curves would be displaced downwardly at a given point of time. After the maximum excursion of the weights, both would tend to return with the fall-off portion of the curve as shown in FIG. 3. What this curve represents is that the recoil diffuser has indeed diffused, or stretched out, the amount of work (force times displacement) over time so that the threshold T is not exceeded. Further to be appreciated from the characteristic curves in FIG. 3 is a differential action by providing weights which differ in conjunction with geometric surfaces of such weights and the spring elements in conjunction with the durometers of such elements. In practice, a force/time characteristic may be made of any device having recoil utilizing standard transducers connected to provide a memory scope trace of force and time. Thereafter, an optimum package profile, such as the shape of tube 12, may be chosen depending upon its positioning within or outside of a recoil generating mechanism such as a gun. Thereafter, weights of different sizes may be selected, factoring in the overall weight of the device, its positioning upon the recoil-generating mechanism, taking into account balance. Next, a variety of spring elements may be chosen and the assembly put together and tested by impact until a suitable characteristic diffused impact displacement is achieved.

For use with a shotgun, a diffuser was fabricated of aluminum tubing 0.975 inches in O.D. having an I.D. of 0.850 inches and a length of 4.15 inches. Lead weights like those shown as 20 and 22 had O.D.s of 0.840 inches and were approximately 1.435 inches for element 20 and 1.170 inches for element 22 and weighed 3 and 2 ounces, respectively. The spring elements were shaped generally as shown above having O.D.s of 0.840 inches and axial lengths of 0.640 inches with respect to elements 32 and 40. Element 40 had a length of 0.250 inches. The elements were of polyurethane having a durometer on the order of 30. The approximate radius R was 0.300 and the approximate radius r was 0.200. Aluminum plugs were used for elements 14 and 16 and a clench on the order of 0.080 inches in depth was employed around the periphery in the manner indicated in the drawings of this application.

While the invention has been illustrated in a preferred mode relative to weaponry, it is fully contemplated that it could have application in any situation wherein impact-generated forces need diffusing. It is further contemplated that the invention may be used in multiple and may be scaled up or down. It is further contemplated that the concave and convex shapes may be given different radiuses to generate the required or desired characteristic force displacement response. It is also contemplated that more than two weights may be employed and that aspects of the invention, including the convex and concave shapes of a given weight and a given spring means may be employed to the advantage of accommodating recoil impact forces.

Having now described my invention in terms intended to enable those skilled in the practice of the art to utilize it, I set forth what it is believed to be invented in the appended claims:

I claim:

1. A recoil diffuser, including:

(a) tube means, (b) multiple weight elements fitted within said tube means for easy sliding movement, (c) a plurality of spring elements fitted within said tube means and coaxed with said weight elements, at least one said spring elements at one end of said tube means and another of said spring elements between each weight element, and (d) end means closing the ends of said tube means to confine said weight elements and said spring elements therewithin in light engagement with each other, (e) said spring elements each including a body of a given material having a hardness and geometric shape to allow weight displacement differentially upon impact caused by recoil forces applied to said diffuser and the elements therewithin;

(f) wherein at least one of said weight elements includes at least one of the ends thereof a concave shape and the said spring element proximate said one end includes a convex shape to extend within the profile of said weight element with said convex shape being smaller than the said concave shape whereby to allow expansion of said spring element into said convex shape.

2. A recoil diffuser, including:

(a) tube means, (b) multiple weight elements fitted within said tube means for easy sliding movement, (c) a plurality of spring elements fitted within said tube means and coaxed with said weight elements, at least one said spring elements at one end of said tube means and another of said spring elements between each weight element, and (d) end means closing the ends of said tube to confine said weight elements and said spring elements therewithin in light engagement with each other, (e) said spring elements each including a body of a given material having a hardness and geometric shape to allow weight displacement differentially upon impact caused by recoil forces applied to said diffuser and the elements therewithin;

(f) wherein one of said weight elements is appreciably heavier than another of said weight elements whereby to provide a differential displacement upon impact caused by recoil of said diffuser.

3. A recoil diffuser, including:

(a) tube means, (b) multiple weight elements fitted within said tube means for easy sliding movement, (c) a plurality of spring elements fitted within said tube means and coaxed with said weight elements, at least one said spring elements at one end of said tube means and another of said spring elements between each weight element, and (d) end means closing the ends of said tube means to confine said weight elements and said spring elements therewithin in light engagement with each other, (e) said spring elements each including a body of a given material having a hardness and geometric shape to allow weight displacement differentially upon impact caused by recoil forces applied to said diffuser and the elements therewithin;

(f) wherein at least one of said weight elements weighs appreciably more than at least another of said weight elements and the said one and another weight elements have concavely shaped ends, at least two of said spring elements proximate said one and another weight elements each having a convex exterior configurations fitted within the concave shapes of said weight elements with the said shapes adjusted to provide room for deformation of said spring elements upon compressive loading by impact recoil of said diffuser.

4. A recoil diffuser, including:

(a) tube means, (b) multiple weight elements fitted within said tube means for easy sliding movement, (c) a plurality of spring elements fitted within said tube means and coaxed with said weight elements, at least one said spring elements at one end of said tube means and another of said spring elements between each weight element, and (d) end means closing the ends of said tube means to confine said weight elements and said spring elements therewithin in light engagement with each other, (e) said spring elements each including a body of a given material having a hardness and geometric shape to allow weight displacement differentially upon impact caused by recoil forces applied to said diffuser and the elements therewithin;

(f) wherein said spring elements include flat radius sections adapted to fit within the interior of said tube means to orient said elements axially therewithin.

5. A recoil diffuser, including:

(a) tube means, (b) multiple weight elements fitted within said tube means for easy sliding movement, (c) a plurality of spring elements fitted within said tube means and coaxed with said weight elements, at least one said spring elements at one end of said tube means and another of said spring element between each weight element, and (d) end means closing the ends of said tube means to confine said weight elements and said spring elements therewithin in light engagement with each other, (e) said spring elements each including a body of a given material having a hardness and geometric shape to allow weight displacement differentially upon impact caused by recoil forces applied to said diffuser and the elements therewithin;

(f) wherein at least two of said weight elements have in the end surfaces thereof concave shapes and at least one of said spring elements has in its ends convex shapes adapted to fit within the said concave shapes of said weight elements and between said weight elements.

6. A recoil diffuser, including:

(a) tube means, (b) multiple weight elements fitted within said tube means for easy sliding movement, (c) a plurality of spring elements fitted within said tube means and coaxed with said weight elements, at least one said spring elements at one end of said tube means and another of said spring elements between each weight element, and (d) means closing the ends of said tube means to confine said weight elements and said spring elements therewithin in light engagement with each other, (e) said spring elements each including a body of a given material having a hardness and geometric shape to allow weight displacement differentially upon impact caused by recoil forces applied to said diffuser and the elements therewithin;

(f) wherein the ends of said weight elements and the adjacent ends of said spring elements are curved in the same direction and provide a space therebetween when the said spring means are in a relaxed condition to accommodate for deformation of said spring elements during impact displacement.

7. A spring system for accommodating axial impact forces including a pair of spaced apart weights, each said weight adapted to be displaced by impact force, said weights each having a concave end surface, a plastic element disposed between said weights having a convex surface adapted to fit within the profile of one of said weights surrounded by said convex surface, the shapes of the said concave and convex surfaces being dimensioned to allow a space therebetween greater at the periphery than at the center axis of said element to provide a differential force displacement characteristic to said system upon impact displacement of said weights.

8. The system of claim 7 wherein said plastic element is comprised of a material of a durometer on the order of between 30 and 40 units.

9. The system of claim 8 wherein one of said weights is appreciably heavier than the other of said weights.

10. The system of claim 7 wherein one of said weights is appreciably heavier than the other of said weights.

* * * * *